US012241364B2

(12) United States Patent
Borg et al.

(10) Patent No.: US 12,241,364 B2
(45) Date of Patent: Mar. 4, 2025

(54) SYSTEM AND METHOD FOR POSITION AND ORIENTATION DETECTION OF A DOWNHOLE DEVICE

(71) Applicant: Aziwell AS, Trondheim (NO)

(72) Inventors: Eirik Borg, Trondheim (NO); Bjørn Christiansen, Trondheim (NO); Tobias Rasmussen, Trondheim (NO)

(73) Assignee: Aziwell AS, Trondheim (NO)

( * ) Notice: Subject to any disclaimer, the term of this patent is extended or adjusted under 35 U.S.C. 154(b) by 0 days.

(21) Appl. No.: 18/566,815

(22) PCT Filed: May 31, 2022

(86) PCT No.: PCT/EP2022/064829
§ 371 (c)(1),
(2) Date: Dec. 4, 2023

(87) PCT Pub. No.: WO2023/280480
PCT Pub. Date: Jan. 12, 2023

(65) Prior Publication Data

US 2024/0271522 A1 Aug. 15, 2024

(30) Foreign Application Priority Data

Jul. 9, 2021 (NO) ..... 20210892

(51) Int. Cl.
*E21B 47/024* (2006.01)
*E21B 7/06* (2006.01)
*E21B 44/00* (2006.01)

(52) U.S. Cl.
CPC ..... *E21B 47/024* (2013.01); *E21B 7/062* (2013.01); *E21B 7/064* (2013.01); *E21B 7/067* (2013.01); *E21B 44/005* (2013.01)

(58) Field of Classification Search
CPC ... E21B 7/04; E21B 7/06; E21B 7/062; E21B 7/064; E21B 7/046
See application file for complete search history.

(56) References Cited

U.S. PATENT DOCUMENTS 2,207,505 A 7/1940 Bremner et al.
4,537,067 A * 8/1985 Sharp ..... E21B 47/022 73/152.13

(Continued)

FOREIGN PATENT DOCUMENTS

| | | | |
|---|---|---|---|
| EP | 3180496 | A1 | 6/2017 |
| EP | 3710669 | A1 | 9/2020 |
| WO | WO-2010050840 | A1 | 5/2010 |
| WO | WO-2016024867 | A1 | 2/2016 |

OTHER PUBLICATIONS

Patent Cooperation Treaty, International Application No. PCT/EP2022/064829, "International Search Report," Jun. 9, 2022, 2 pages.

*Primary Examiner* — David Carroll
(74) *Attorney, Agent, or Firm* — Bradley Arant Boult Cummings

(57) ABSTRACT

The present invention relates to a system for identifying or monitoring the orientation and position of a rotary steerable drill for drilling in bedrock, wherein the system comprising; •a substantially non-rotating outer body element (1) housing at least one reference point magnet (14), and •a rotating drive shaft (3), arranged inside the outer body element (1), that is connected to a drill bit (4) at its first end and to the drill rod (5), and •an inner body element (11) that is arranged inside the drive shaft (3), drill rod (5) or coupling thereof and where the inner body element (11) can be seated and retrieved from surface by means of a wireline. The inner body includes: —a cradle or platform (23) is arranged essentially concentrically inside the inner body element (11) being suspended rotationally free to the inner body element (Continued)

(11) enabling the cradle or platform (23) to freely rotate relative to the inner body element (11). The cradle or platform also includes at least one gravity sensor for at any time measuring the direction of earth's gravity relative to the said cradle or platform (23), and at least one alignment device (19) configured to align said cradle or platform (23) in a known rotational position relative to a reference constituted by the reference point element (14) or the direction of earth's gravity.

13 Claims, 4 Drawing Sheets

(56) References Cited

U.S. PATENT DOCUMENTS

| | | | | |
|---|---|---|---|---|
| 6,158,529 | A * | 12/2000 | Dorel | E21B 7/067 175/61 |
| 7,725,263 | B2 | 5/2010 | Sugiura | |
| 9,650,834 | B1 * | 5/2017 | Bargach | E21B 7/067 |
| 2004/0231893 | A1 | 11/2004 | Kent | |
| 2006/0021797 | A1 | 2/2006 | Krueger | |
| 2008/0201969 | A1 | 8/2008 | Davies et al. | |
| 2013/0126239 | A1 * | 5/2013 | Panchal | G05B 15/02 175/24 |
| 2013/0140087 | A1 * | 6/2013 | Koch | E21B 47/017 175/40 |
| 2019/0271193 | A1 * | 9/2019 | Peters | E21B 47/13 |

* cited by examiner

A - A

SYSTEM AND METHOD FOR POSITION AND ORIENTATION DETECTION OF A DOWNHOLE DEVICE

TECHNICAL FIELD OF THE INVENTION

The present invention relates to a system and a method for identifying or monitoring the orientation and position of a deflection mechanism relative to earth gravity during drilling. Said deflection mechanism being attached to a downhole directional drill based on the concept known as rotary steerable system (RSS), where the drill bit is driven by a rotational drive shaft running through a substantially non-rotating outer body element holding the deflection mechanism. The orientation system comprising an orientation unit including a magnetic reference point element fixed to the non-rotational outer body element of the RSS drill, and a sensing retrievable inner body element arranged inside the outer body element of the RSS drill.

BACKGROUND OF THE INVENTION

Several ways of identifying and monitoring the orientation and position of an RSS drill are known in the prior art. In EP3180496 several such solutions have been discussed, from employing a mule shoe to more complex alternatives for estimating the orientation of tools present in wellbores and similar.

EP3180496 describes a system for identifying or monitoring the orientation and position of a downhole device such as an RSS drill or wedge, the system comprises an orientation unit including a reference point element attached to an outer body element and a retrievable inner body element arranged within the outer body element. The inner body element comprising at least one first and one second sensor, wherein the first sensor measures the rotational position of the reference point element such as a magnet and the second sensor, such as an accelerometer, measure the direction of the earth's gravity field.

EP3180496 further describes in relation to one embodiment illustrated in FIG. 2 an arrangement where an alignment magnet is suspended rotationally free inside the inner body element, where the alignment magnet is arranged in such manner that the alignment magnet always will align itself with the reference point magnet fixed or locked to the outer element of the device due to the magnetic field forces. A first sensor is used to measure the orientation of the alignment magnet relative to the rest of the inner body element which may include a gravitation sensor. This way the first sensor can measure the rotational position of the alignment magnet, thus the rotational position of the reference point element, and the second sensor such as an accelerometer measure the direction of the earth's gravity field. The patent also suggests radioactive source, laser, permanent magnet, electromagnet and Radio Frequency Identification (RFID) as an alternative to the use of reference magnets, which would imply active rotation of the alignment shaft.

The system in EP3180496 further comprises a processor using data from said first sensor and the second sensor to calculate the rotational position of the reference point element relative to the direction of earth gravity and means for accessing such data.

One limitation related to both configurations described in EP3180496 is that when used in an RSS drill during drilling, the accuracy of the readings is significantly reduced by centripetal forces, since the accelerometers sensors are seated in a fixed manner inside the inner body element thus rotate along with the drive shaft. The problem relates to the fact that a gravity sensor cannot easily distinguish between gravity, applied acceleration and centripetal forces i.e. a moving gravity sensor will not be able to provide reliable data about direction of gravity.

Consequently, it is a known problem within the industry to obtain accurate gravity readings from moving accelerometers. Systems for down hole orientation of RSS drills where measurements of earth gravity are a parameter for calculation of tool orientation is thus typically only used when the system are at standstill state, unless means to compensate for centipedal forces are implemented. It is known from prior art systems to use complex algorithms to compensate for errors in gravity data caused by the centripetal forces during drilling as well as specially adopted mechanical gravity sensors. It is also known in prior art to use other references, such as magnetic north, to omit the problems related to gravity measurements in a rotational system. Finally, its known in prior art to locate the gravity sensors at the substantially stationary outer body element holding the deflection mechanism to omit the problems related to gravity measurements in moving parts. The latter will however require a relatively complicated system for transferring signals from the stationary outer body element to the rotational drive shaft or coupling thereof, to be able to communicate with the system from surface. Furthermore, it will not be possible to retrieve the system to surface. Common for all the above systems are that they are complicated and not reliable.

The limitation of obtaining reliable measurements from gravity sensors during drilling ie. when they are rotating is addressed in US 2008/0201969 where data from several accelerometers are being processed in complex algorithms in an attempt, to provide a correction for the movements. US 2004/0231893 discusses an alternative using a movable metallic weight in an attempt, to avoid the problems related to moving accelerometers.

EP3180496 do have the advantage compared to other systems that the sensors are concentrically placed, thus the centripetal forces are kept to a minimum, but still, it is a significant obstacle, given the fixed relation to the inner body element, thus they will rotate during drilling.

According to the present invention the alignment by means of magnetic forces between the substantially non-rotating outer body and the platform carrying the sensors, provides a substantially non-rotating seat for the gravity sensors, thus the invention eliminates the severe problems originating from use of gravity sensors in RSS drill where the sensors otherwise would rotate along with the drive shaft.

A relevant solution is discussed in US2013/140087 where the outer rod section (1) has a first magnet wherein an inner rod section (2) is carrying an inner probe (3) suspended rotationally free. Said inner probe being provided with a second magnet. The two magnets are arranged in such way that they attract each other, thus the inner probe (3) is rotationally coupled to the outer rod section (2) by means of magnetic forces, while being rotationally uncoupled from the inner rod section (2). Even if US2013/140087 does not identify gravity measurements during drilling as a problem to be solved, the patent is still relevant given the description of a magnetically coupled sensor probe.

The solution in US2013/140087 has however several disadvantages since the complete probe is suspended rotationally free inside the inner rod section (2). Suspending the complete probe rotationally free will require that a relatively large and heavy structure must be held in position by the magnetic forces. A magnetic coupling is relatively weak by any means compared to a fixed coupling thus size and weight will have negative influence on the rotational stability of the probe.

Another disadvantage is that the probe suspension bearings unavoidably will be exposed to contamination from eg. drilling mud and cuttings. Contamination is highly problematic, where even the smallest contamination within the bearings may lead to failure. Sealed bearings could be an alternative, but will cause undesired drag, since high-pressure seals is needed for a down hole application. Another issue is potential contamination from micro leakage and wear over time, both well-known in rotational shaft seals.

Furthermore, the described solution relays on cable connection up to surface for power supply and communication, thus the described solution is not compatible with standard wireline and will require additional equipment for data collection and power supply at surface.

Another significant disadvantage is that the described solution does not facilitate use of probe data down hole or use of the probe as an electronic platform for sensors and devices operating outside the probe. It is known that directional drills usually comprise a range of sensors and devices such as pressure sensors, motors, solenoids and similar working together as a system.

In another embodiment not described in US2013/140087 the rotationally suspended probe could comprise all means needed for data collection including power supply. This would eliminate some of the problems described above, but also add considerably more weight and size to the probe, thus make the magnetic coupling even less reliable and it will not solve the problems related to contamination of suspension bearings. Furthermore, it will not easily facilitate use of probe data down hole or use of the probe as an electronic platform for sensors and devices operating outside the probe.

Finally, one could suspend the complete sensor assembly rotationally free inside the probe. Having the complete sensor assembly ie. sensor/s, processor/s and power supply on the same platform, said platform being suspended rotationally free would solve the suspension bearing issues since the bearings now will be protected inside the probe, but again add considerably more weight and size to the rotationally suspended platform, thus make the magnetic coupling less reliable. The power supply is here especially relevant as it usually consists of a relatively large and heavy battery pack. Another issue is that the solution will require that charging or replacement of the batteries as well as data communication must be done directly at the relatively fragile rotationally suspended platform, thus the bearings will be exposed for potential contamination and damage if not in the same extend as having the complete probe suspended rotationally free. Direct access to the rotationally suspended platform should thus be avoided.

To implement wireless charging and data communication to avoid direct access to the rotationally suspended platform could be an alternative but given that the system is intended for down hole use and thus exposed to high pressure, this would not be a desired solution, as it will require a non-metallic ie. weaken opening in the probe structure for signal transfer. Furthermore, the system would not be easily adopted to operate as a processing unit for sensors and devices operating outside the rotationally suspended platform, given that it will not be possible to communicate through fixed wires. In all senses it would not be a desired solution to hook up a range of additional sensors and devices to a rotational object.

OBJECTS OF THE INVENTION

It is therefore an object of the present invention to provide a more reliable and easy way of obtaining orientation data for RSS drills relative to earth gravity during drilling, ie. when the sensor probe is seated inside the rotational drive shaft or a coupling thereof and thus is rotational during drilling, compared to prior art. It should also be appreciated that the system described herein provides high quality orientation measurements without the limitations known from prior art during drilling as well as when the drill is at standstill state.

Moreover, it is an object of the invention to provide an orientation system for RSS drills that in its preferred embodiment can provide orientation data for the RSS drill relative to earth gravity with just one sensor type and by such avoid using a $2^{nd}$ sensor as disclosed in EP3180496, US 2008/0201969 and US 2004/0231893

Moreover, it is also an object of the invention to provide an orientation system for RSS drills that can provide orientation data for the outer body element and its deflection mechanism, relative to earth gravity independently and at any time, thus at any rotational position of the inner body element, drive shaft, drill rod or couplings thereof. Consequently, measurements can be obtained equally regardless of the driveshaft being standstill or rotational and no alignment devices on or attached to the inner body element is needed as one know from the mule shoe system, and there will be no need for locking coupling/-s, share pin/-s or other alignment devices between the drive shaft, drill rod or couplings thereof, and the non-rotating outer body element.

It is also an object of the invention to provide an orientation system for RSS drills that can be either seated permanently or lowered from surface and seated in the RSS drill downhole at need, as well as released from the RSS drill and hoisted to surface for downloading data, re-programming, or servicing if malfunctioning. Said lowering and hoisting is done by wire line or similar methods known from prior art, while the RSS drill is stationary downhole.

Yet another object of the invention is to provide an orientation system where the platform is suspended rotationally free and limited to only comprising the gravity sensors to minimize weight and size of the cradle or platform, thus a more stable and reliable stabilization of the gravity sensors can be obtained.

It is also an object of the invention to provide a system that can act as processing unit for additional sensors and devices in the drill, without the need to access the platform that is suspended rotationally free and carrying the gravity sensors. The same goes for battery charging and data download as well as communication with the processor. In practice the said platform could be in a sealed compartment away from the batteries and the main electronic board carrying the processing unit. Furthermore, there will be no limits for size and weight of the power supply eg. batteries and the processing unit.

The objects stated above are achieved by means of a system and a method as further defined by the independent claims, while embodiments, variants and alternatives are defined by the dependent claims.

It is emphasized that the phrase "non-rotating" or "stationary" referring to the outer body element, in this application does not limit the possibility of changing or adjusting the rotational position of the outer body element to change the drilling direction, also known as tool face. Furthermore, the outer body element in some cases may rotationally slip or drift during drilling.

It is also emphasized that the phrase "relative to earth gravity" is referring to the direction of earth gravity ie. downwards and directly towards center of earth.

It is furthermore emphasized that the phrase "measuring the rotational position" without referring what it is relative too, is to be understood as relative to the sensor or direction of earth gravity.

At last, its emphasized that the phrase "rotationally suspended" is to be understood as "suspended rotationally free.

SUMMARY OF THE INVENTION

The main principle of the present invention is to provide an alternative orientation system especially for a RSS drill having the orientation system fixed to or seated inside the rotational drive shaft, that is more reliable, easy to use and less complex than prior art, for direct determination of the circumferential position of a reference point element fixed to a non-rotating outer body element holding a deflection mechanism of an RSS drill, relative to earth gravity at any time or at certain periods in time, regardless of whether the drill is operational and drilling or at standstill state, and to collect such information, so that the direction of the deflection mechanism and thus drilling direction can be determined and/or calculated.

It is emphasized that the phrase "at any time" implies that readings can be done independent of the rotational position of the inner element holding the sensor. This unlike the pick-up principle where readings can be achieved only at the time the sensor is passing by the reference point, thus it requires that the drill shaft rotates, or as known with the mule shoe principle where the sensor need to be aligned in a fixed known position relative to the reference point before reading can be done. For an RSS drill the latter implies two rather complicated couplings, one for aligning the sensor relative to the guide pin or shoe located in the drive shaft, drill rod or couplings thereof and one for aligning the drive shaft, drill rod or couplings thereof relative to the outer body element.

Furthermore, the readings can be done regardless of the drive shaft, drill rod or couplings thereof holding the inner body element and its sensors, being rotational or at stand still state. Such determinations or calculations may be real-time activities or logged for later downloads at surface or downhole, and if desired, used for adjustment of the drilling direction of the RSS drill.

It is a significant advantage for the system to limit the platform to only carry the low weight accelerometers in order to enhance the platforms capability of maintaining a fixed orientation relative to the reference magnet during the drilling operation while locating the rest of the instrument such as the power supply as well as main electronic board carrying the processing unit on a separate part of the device wherein the fixed external electronics board being configured to receive, store and process the signals, and possibly to communicate the results to operator or equipment on the surface.

Thus, the present invention provides a low weight and easily stabilized sensor platform communicating with the corresponding electronic circuitry but being rotationally independent of the battery as well as the main electronic circuit board carrying the processing unit. This way the impact of the drilling operation on the gravity measurement is reduced to a minimum thus the measurements will be more reliable.

A typical non-coring RSS drill comprises:

- a substantially non-rotating outer body element housing an anti-rotation device preventing the outer body element to rotate but allowing the outer body element to move in the longitudinal direction during drilling and a deflection mechanism to tilt or push the drill bit and thereby achieve a change in the direction of drilling, and
- a rotating drive shaft, partially arranged inside the substantially non-rotating outer body element that is connected to a drill bit at its first end and connected to the drill string at its second end, and an inner body element fixed to the rotational driveshaft comprising an orientation unit A typical coring RSS drill comprises:

- a substantially non-rotating outer body element housing an anti-rotation device preventing the outer body element to rotate but allowing the outer body element to move in the longitudinal direction during drilling and a deflection mechanism to tilt or push the drill bit and thereby achieve a change in the direction of drilling, and
- a rotating drive shaft, partially arranged inside the substantially non-rotating outer body element that is connected to a drill bit at its first end and connected to the drill string at its second end,
- a core tube assembly being adopted to receive core samples during drilling, said core tube assembly comprising a lock and release coupling facilitating locking and releasing of the core tube assembly relative to the driveshaft or coupling thereof, as well as connection for hoisting the core tube assembly to surface for emptying the core tube. and
- an inner body element attached to the core tube assembly that due to the properties of the said lock and release coupling will be seated in a rotationally random position inside the drive shaft. Said inner body element comprising an orientation unit, wherein the inner body element is substantially rotating along with the drive shaft during drilling operation due to frictional forces or the fixation caused by the lock and release coupling and where the inner body element is retrievable to surface by wireline as a part of the core tube assembly.

According to the preferred embodiment of the present invention the orientation system for an RSS drill may according to the preferred embodiment of the invention include:

- a reference point magnet fixed to the non-rotating outer body element, and
- a section of the drill shaft in the near proximity of the outer body element reference point magnet is made in a substantially non-magnetic material, and
- a platform suspended essentially concentrically as well as rotationally free inside the inner body element, and said platform houses an alignment magnet that aligns said platform with the reference magnet due to the magnetic forces imposed between the two magnets.
- said platform further houses at least one gravity sensor measuring the direction of earth's gravity, and in fixed relation to the inner body element ie. rotating along with the driveshaft

- a main electronic board comprising at least one processor for retrieving data from the gravity sensor, using such data for calculating and/or determining the rotational orientation of the platform relative to earth gravity, and hereby the rotational orientation of the fixed reference point element thus deflection mechanism, relative to earth gravity. The data from the accelerometer may also be used to calculate the inclination of the device, drive shaft rotational speed and orientation of a core sample as well as input for manual or autonomous downhole adjustment of drill parameters such as degree of deflection and tool face.

a memory for logging of measured data and means for downloading or access said data when needed.

a power supply unit such as a battery providing power supply to the inner body and its electronics.

It is to be understood that the platform carrying the gravity sensor must comprise means to receive power and to communicate with the main electronic board, preferably wirelessly.

The reference point element comprises at least one magnetic field, preferably created by a permanent magnet. The gravity sensor comprises at least one gravity sensor being configured to measure the direction of the earth gravity relative to the measuring unit, such as inclinometer and/or accelerometer, preferably a tri-axes accelerometer.

In this application, whenever the word "magnet" is written it should be interpreted as a permanent magnet, electro magnet or a magnetic field made in any other way.

Preferably, the reference point magnet/s is placed in fixed seat/s on the substantially non-rotating outer body element, intended to create an artificial magnetic field that engage with the platform alignment magnet.

The platform can be of any shape or size suitable for the holding the gravity sensor and the alignment magnet, furthermore the gravity sensor can be placed directly on the alignment magnet, or the alignment magnet can act as a platform itself or it can be an integrated part of the platform.

The gravity sensor arranged on the platform provides alone sufficient data to determine the rotational position of the reference point magnet relative to the direction of earth gravity and thereby the rotational position of the deflection mechanism that determine the direction of drilling relative to the direction of earth gravity.

Since the platform will be kept stationary by means of magnetic forces between the reference point magnet seated on the non-rotating outer body element and the platform alignment magnet, also while drilling, the use of gravity sensor such as an accelerometer will not be influenced by centripetal forces as being the case for EP3180496, US 2008/0201969 and US 2004/0231893. The orientation system according to the present invention can thus monitor the rotational position of the outer body element and its deflection mechanism relative to earth gravity at any time, herein drift or movement, in real time and without compensating for centripetal forces, during the drilling operation as well as when the RSS drill are at stand still state.

According to an alternative embodiment of the present invention the gravity sensor is configured to sense at any time the rotational position of the platform relative to the direction of the earth gravity.

the platform further comprises a magnetic field sensor and being connected to an external electric motor with a shaft or magnetic coupling, said motor being located outside the rotationally suspended platform holding the sensors and adapted to aid the stabilization of the platform orientation.

the main electronic board comprises at least a processor for retrieving data from the gravity sensor, using such data as input for keeping said platform fixed in known rotational position relative to earth gravity by means of the electric motor, and said processor furthermore retrieving data from the magnetic field sensor to determine the rotational orientation of the fixed reference point element relative to the said platform, thus one can determine the rotational position of the reference point element relative to earth gravity.

the data from the accelerometer may also be used to calculate the inclination of the device, drive shaft rotational speed and/or orientation of a core sample as well as input for manual or autonomous downhole adjustment of drill parameters such as degree of deflection tool face.

a memory for logging of measured data and means for downloading or access said data when needed.

a power supply unit such as a battery or generator fixed to the inner body element providing power supply to the motor, sensors and processor.

alternatively, the processor may retrieve data from the magnetic sensor, using such data as input for keeping said platform fixed in known rotational position relative to the reference point element utilizes the electric motor, and said processor furthermore retrieving data from the gravity sensor to determine the rotational orientation of the fixed reference point element, relative to earth gravity.

The reference point element comprises at least one magnetic field, preferably created by a permanent magnet, the gravity sensor comprises at least one gravity sensor, such as inclinometer and/or accelerometer, preferably a tri-axes accelerometer.

Preferably, the reference point magnet/s is placed in fixed seat/s on the substantially non-rotating outer body element, intended to create an artificial magnetic field that can be detected by the magnetic field sensor.

The platform can be of any shape or size suitable for the holding the sensors.

In one embodiment the gravity sensor provide data to the alignment motor keeping the platform in a known rotational position relative to earth gravity, thus the magnetic field sensor arranged on the platform provides data to determine the rotational position of the reference point magnet relative to the direction of earth gravity, and thereby the rotational position of the deflection mechanism that determine the direction of drilling relative to the direction of earth gravity.

Since the platform will be kept in a fixed stationary position, also while drilling, the use of gravity sensor such as an accelerometer will not be influenced by centripetal forces as being the case for EP3180496, US 2008/0201969 and US 2004/0231893.

The rotational fixation of the platform by means of a motor can be done constantly, at given intervals or at certain moments in time when orientation data is needed. The main advantage of a motor stabilized system is that it provides means to reliable monitoring of the rotational orientation of the outer body and its deflection mechanism relative to earth gravity, even if the outer body is rotating ie. not stationary. It is known from prior art deflection mechanisms that are rotational, typical at relatively low speed, wherein the said deflection mechanisms comprise means for continuous adjustment to stabilize the tool face While the use of a motor is not according to the preferred embodiment of the invention the solution may have an advantage if the diameter of the drill is too large to magnetically stabilize the platform or if the outer element rotates at speed that significantly deteriorate the gravity reading or as said if the outer body element is rotational.

The orientation system according to the present invention can thus monitor the rotational position of the outer body element and its deflection mechanism relative to earth gravity at any time, herein drift, movement or when rotational, in real time and without additional compensating for centripetal forces, during the drilling operation and as well as when the RSS drill are at stand still state.

The invention will be described below with reference to the accompanying drawings, illustrating the invention by way of examples.

FIG. 1 illustrates a steerable non-coring drill system according to the prior art incorporating the present invention.

FIG. 2 illustrates a steerable coring drill system according to the prior art incorporating the present invention.

FIG. 3 illustrates a longitudinal section of first embodiment of the present invention including an inner body element with sensors, processor and battery.

FIG. 4 illustrates a cross section of the embodiment illustrated in FIG. 3.

FIG. 5 illustrates a first embodiment of the inner body element.

FIG. 6 illustrates a second embodiment of the inner body element.

FIG. 7 illustrates a third embodiment of the inner body element with alignment motor.

BRIEF DESCRIPTION OF THE DRAWINGS

For detailed understanding of the invention, references should be made to the following detailed description taken in conjunction with the accompanying drawings in which like elements are generally designated by like numerals, and wherein.

Figure 1:
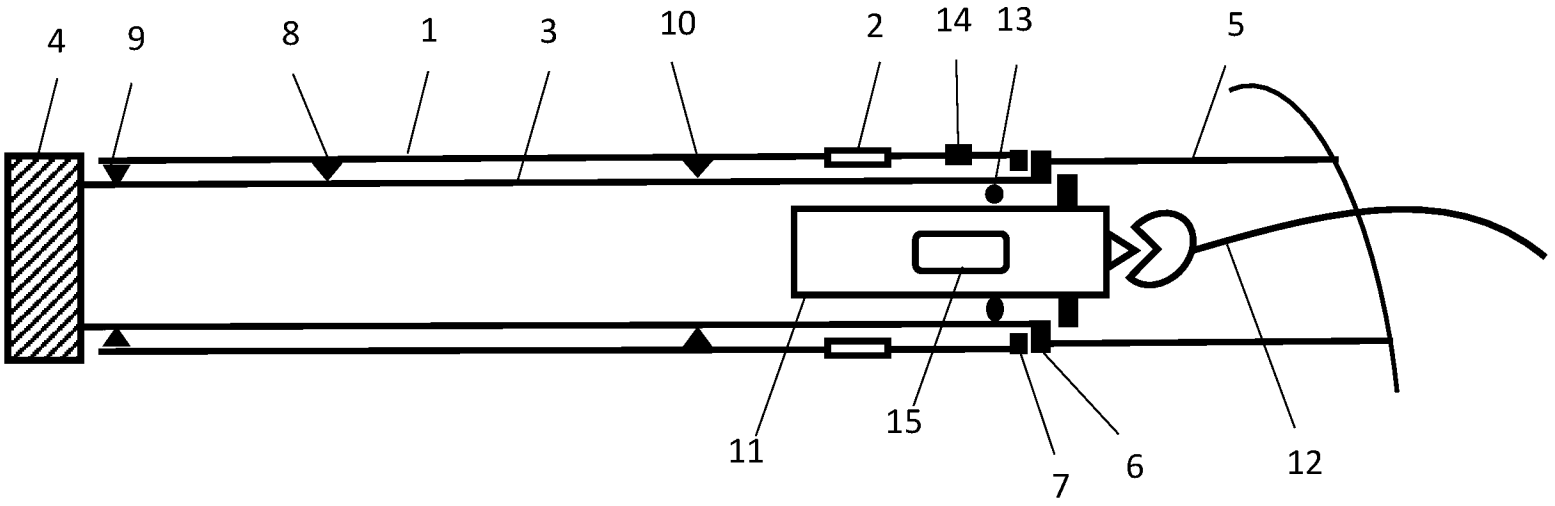
FIG. 1 shows a schematic illustration of a non-coring RSS drill according to prior art technology, which assembly includes; an substantially non-rotating tube-shaped outer body element (1) housing an anti-rotation device (2) such as a packer interacting with the rock formation (not shown) outside the outer body element (1) thus preventing the outer body element (1) to rotate along with the drive shaft (3) but allowing the outer body element (1) to move in the longitudinal direction during drilling and a deflection mechanism (8) for pointing or pushing the drill bit (4) and thereby achieve a change in the direction of drilling. The drive shaft (3) is running through the interior of the outer body element (1) and is having a drill bit (4) at its first end and connected to the drill string (5) at its second end. The deflection mechanism (8), is in this figure illustrated as an eccentric bearing, additionally requires a front bearing (9) and a rear bearing (10) to obtain the functionality of changing the direction of drilling. Other deflection means are also known from prior art, to steer the RSS drill in a desired direction without this being relevant for the scope of the invention. The outer non-rotating outer body element (1) is pushed in the borehole in longitudinal direction during drilling by the drill string (5). To accommodate for the relative rotation between the elements a thrust bearing (6,7) is arranged at the rear end of the outer body element (1). The thrust bearing stator element (7) is seated on the outer body element (1) and the thrust bearing rotor element (6) is seated on the drill string (5) or couplings thereof. The magnitude of the thrust force to be transferred though the trust bearing is primarily determined by the frictional forces imposed by the anti-rotation device (2) towards the borehole wall (not shown). Other configurations for placement of eg. deflection mechanism, thrust bearing and anti-rotation device is also possible without this being relevant for the scope of the invention. Within the drive shaft (3) an inner body element (11) including measuring instrument section (15) is accommodated according to the invention. The inner body element (11) can be seated permanently or retrieved to surface by wireline (12) at need. Since retrieval interrupt the drilling operation, real-time downhole communication systems like mud pulse or a wireline especially adopted for signal transfer.

The orientation system for RSS drills according to the present invention thus comprises the inner body element (11), and a magnetic reference element (14) fixed to the non-rotating outer body element (1) in a known rotational position relative to the deflection mechanism (8).

According to the preferred embodiment of the invention when used in a coring RRS drill the core tube assembly holding the inner body element (11) connects to a seat (13) in a rotationally random position inside the drive shaft, drill rod or couplings thereof, the inner body element (11) will thereby substantially be rotating along with the drive shaft during drilling operation. The inner body element houses an instrument section (15) according to the invention, that determine the rotational position of the reference element (14) relative to the direction of earth gravity. It should be emphasized that the instrument section (15) can be arranged at either side of the bearing (17) or at any other suitable location of the inner body element.

Figure 2:
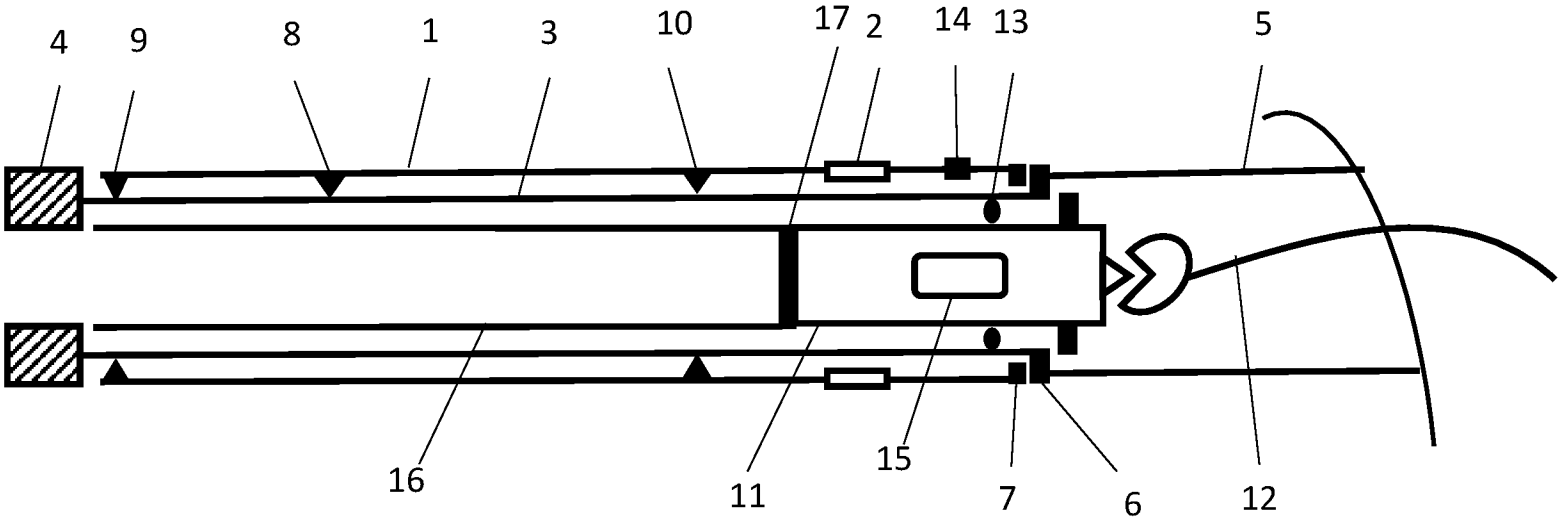
FIG. 2 shows a schematic illustration of an RSS drill according to prior art technology able to collect core samples as it penetrates the bedrock by means of a drill bit (4) comprising a center hole at its facing. Additionally, to the assembly shown in FIG. 1, the core tube assembly is shown comprising an core tube (16) for collecting and holding the core sample as its obtained from the bedrock during drilling and an inner body element (11). The core tube (16) has a bearing (17) preventing the core tube from rotating during drilling operation. Since the core tube (16) needs to be emptied at surface, typically every $3^{rd}$ meter of drilling, the core tube assembly including the inner body element (11) with the instrument section (15) will be retrieved to surface by a standard wireline frequently. Orientation data are thus available for download typically every $3^{rd}$ meter making the present orientation system particularly suited for this application.
Figure 3:
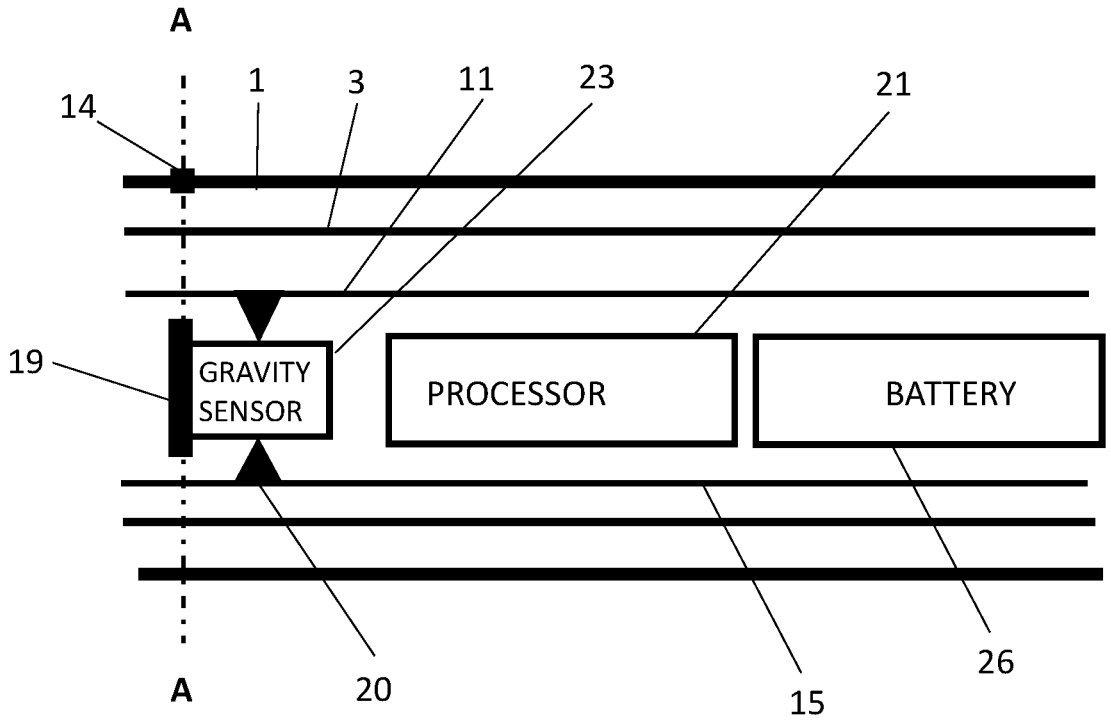
Figure 4:
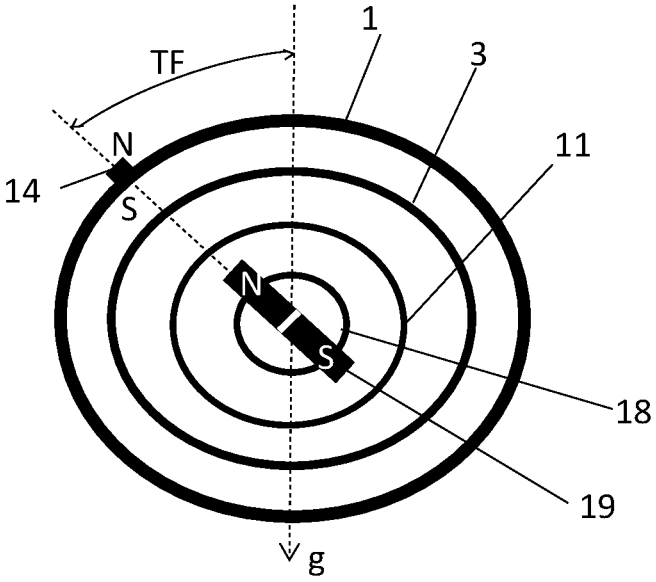
Figure 5:
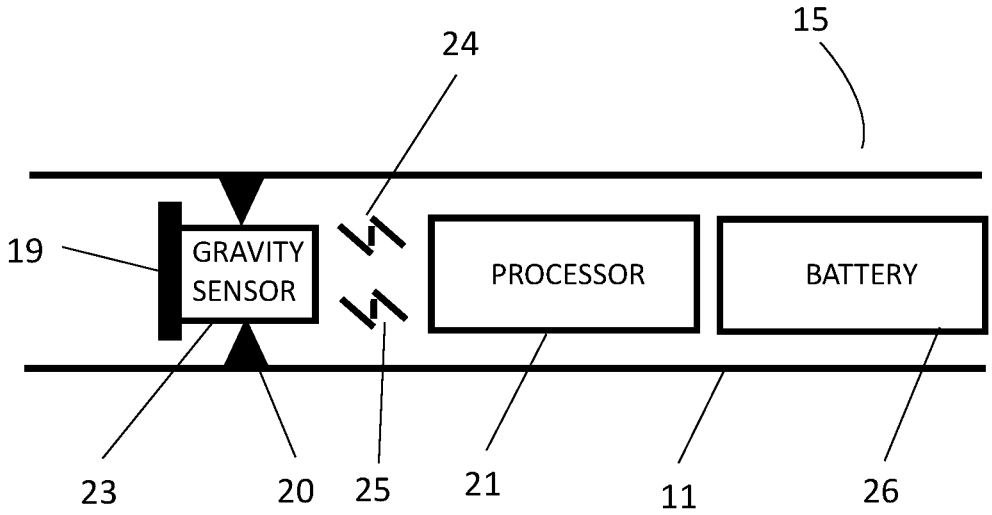

FIGS. 3, 4, 5 and 6 shows preferred arrangements of the orientation system according to the invention used in FIGS. 1 and 2. FIG. 3 shows a longitudinal view of the orientation system while FIG. 4 shows the cross-section A-A of FIG. 3. FIG. 5 shows a preferred embodiment for supplying power to the cradle or platform without this being relevant for the scope of the invention.

Referring to FIGS. 3, 4, 5 and 6 a platform (23) is shown suspended concentrically as well as rotationally free inside the retrievable inner body element (11), enabling the platform (23) to freely rotate relative to the inner body element (11), the system further show an alignment device in form of a alignment magnet (19) located on the said platform (23) that aligns and keep the said platform (23) at all time in a fixed known rotational position relative to the reference magnet (14) due to the magnetic forces imposed between the two magnets. The drive shaft (3) section surrounding the alignment magnet (19) should preferably be made of a substantially non-magnetic material to not disturb the magnetic field between the alignment magnet (19) and the reference magnet (14).

Said platform (23) houses at least one gravity sensor measuring the direction of earth's gravity relative to the orientation of said platform (23). The gravity sensor will thus be kept substantially stationary and in a known rotational position relative to the reference magnet (14) also during drilling operations. A processor and a battery are fixed to the inner body element (15), for retrieving data from the gravity sensor, using such data for calculating and/or determining the rotational orientation of the platform (23), and hereby the rotational orientation of the fixed reference point element (14) relative to earth gravity, denoted as TF (Tool Face) in FIG. 4. It should be appreciated that the algorithms applied for calculating the orientation of the drill tool orientation and for creating an image of said orientation, are standard mathematics solely using data from the single gravity sensor measuring the gravity along minimum two axis, ie. corrections for centrifugal forces as known from prior art are not needed. The data may also be used to calculate the inclination of the device, rotational speed of the drive shaft and/or orientation of a core sample provided the sensor measure the gravity along three axis. A tri-axis accelerometer is thus the preferred gravity sensor to be used.

It should be appreciated that the configuration shown in FIGS. 3, 4, 5 and 6 having only the gravity sensor rotationally suspended provides a system that has very little mass, thus it has high shock resistance, and it is easy for the reference point magnet to keep the cradle or platform stable and in correct position relative to the reference point magnet at all time.

It is noted that the system may be dynamic and as mentioned above there may be cases where the outer pipe with reference element (14) drifts relative to the earth and formation outside. If the magnet is aligned with the reference magnet the gravity sensor will measure a change in the direction of the gravity. The deviation of this change in TF, i.e. the angle relative to the axis of the measured direction, will still provide a measure of the orientation and direction of the pipe, and may also be used to measure the rotation of the outer body element (1)

For clarity, the instrument section (15) in FIGS. 1 and 2 comprises according to the invention the following elements:

- a free rotating platform (23) housing at least one gravity sensor and at least one alignment magnet (19) and, fixed to the inner body element, ie. rotating along with the driveshaft

- at least one main electronic board (21) comprising least one processor for processing and retrieving data from at least the gravity sensor, and,
- at least one power supply unit (26) such as a battery or a power generator providing power to the electronic components.

Figure 6:
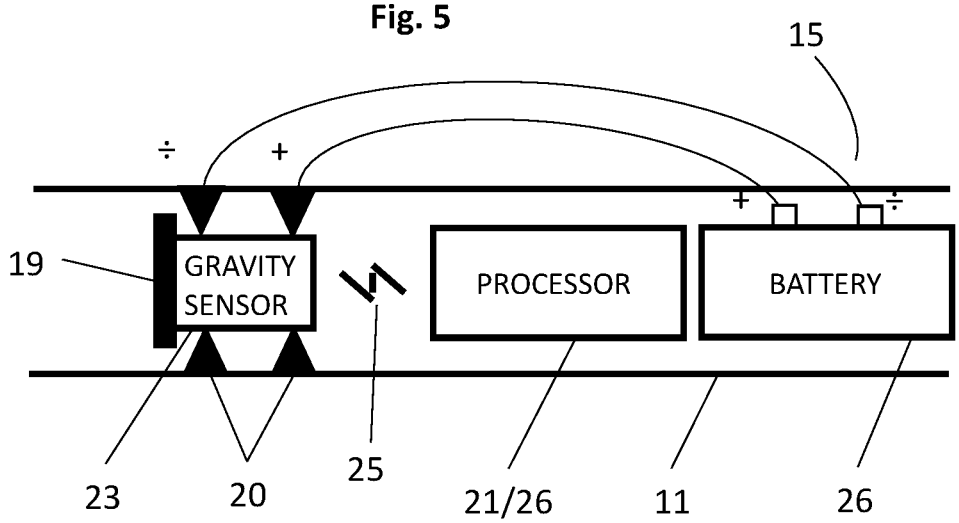

FIG. 5 shows a preferred configuration of the power supply system to the gravity sensor, using wireless (24) according to the invention, but connection through the respective pair of suspension means (20) such as but not limited to suspension bearings (20) as shown in FIG. 6 might also be feasible.

In a preferred configuration according to the invention the gravity sensor communicates with the processor via wireless communication (25), but a wired connection might also be feasible by using a preferably contactless slip ring contact. It is commonly understood that wireless communication requires a communication module arranged at the platform and a receiver at the main electronic board. It is to be understood that wireless connections both for data and power can be achieved by means of "state of the art" wireless technology.

In a preferred configuration according to the invention, data from the processor can be accessed via Bluetooth (BT) or other wireless communication systems while the inner body element (11) is at surface, but it might also be feasible by using a cable connection from downhole or at surface or means for wireless down hole communication.

Figure 7:
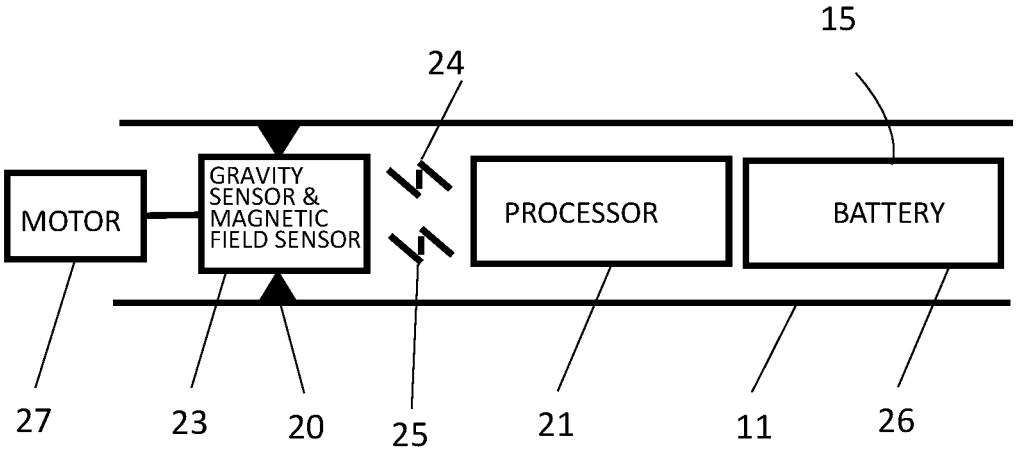

FIG. 7 shows the platform (23) suspended rotationally free inside housing, carrying a gravity sensor and a magnetic field sensor, connected to an alignment device such as an electric motor (27) which rotational speed is controlled by data provided from the gravity sensor. Said motor will in continuous mode run the cradle CCW (Counter Clock Wise) with the same speed as the drive shaft is running CW (Clock Wise) during drilling, in order to keep the platform rotationally fixed in a known position relative to the earth gravity. Alternatively, the motor (27) can be set to conditional mode, meaning that the motor (27) is placing the platform (23) rotationally fixed in a known position relative to earth gravity at certain times or events such as time intervals or when the drill is in standstill mode. If the rotational speed of the drilling shaft is known or controlled in other way the motor (27) may simply be synchronized with the known speed without using a magnetic field sensor.

In an alternative configuration, the rotational speed of the motor is controlled by data provided from the magnetic field sensor to keep the platform (23) rotationally fixed in a known position relative to the reference point element and the gravity sensor to measure the rotational position of the platform (23) relative to earth gravity.

The motorized embodiments are beneficial in the way that it does not relay directly on magnetic forces to keep the platform in position, thus its more robust and less sensitive to the mass of the platform.

To summarize the present invention thus relates to a system for identifying or monitoring the orientation and position of a rotary steerable system drill especially for controlled drilling in bedrock or corresponding geological structures.

The system may therefor preferably comprise:

- A substantially non-rotating outer body element (1) housing at least one reference point magnet (14) in a selected position on the outer body element, typically representing the rotational position of a deflection mechanism. An anti-rotation device (2) such as a packer, knives, wheels or guide bars/pads for preventing the body element to rotate relative to gravity while allowing the body element to move in the longitudinal direction during drilling at the application of a longitudinal force.
- A rotating drive shaft (3) arranged inside the outer body element (1), being connected to a drill bit (4) at its first end and to a drill rod (5) or coupling thereof at its second end. The system also comprises a deflection mechanism (8) to point or push the drill bit (4) at an angle relative to the axis of the drill and thereby achieve a change in the direction of drilling as it is known in the prior art.
- An inner body element (11) that is arranged inside the drive shaft (3), drill rod (5) or coupling thereof in a longitudinal position The inner body element (11) is configured to be seated permanently or retrieved to surface by means of a wireline.

The inner body element includes;

A platform (23) suspended essentially concentrically as well as rotationally free to the inner body element (11). This enables the platform (23) to freely rotate relative to the inner body element (11).

The platform (23) houses at least one alignment magnet (19) that aligns said platform with the reference magnet (14) due to the magnetic forces imposed between the two magnets.

The platform (23) further houses at least one gravity sensor, preferably a tri-axis accelerometer for at any time measuring the direction of earth's gravity relative to the said platform (23).

In fixed relation to the inner body element ie. rotating along with the driveshaft A main electronic board (21) comprising a processor for retrieving and storing data from the gravity sensor and using such data for directly or indirectly at any time calculating and/or determining the rotational orientation of the magnetic reference point element (14) relative to the direction of earth gravity, and thereby the rotational position of the deflection mechanism relative to the direction of earth gravity that determine the direction of drilling.

A power supply unit (26) such as a battery or power generator providing electric power to the gravity sensor.

According to the preferred embodiment of the invention the platform (23) includes only the alignment magnet (19), the gravity sensor and connections allowing communication with the main electronic board (21), so as to reduce the weight of the platform to a minimum.

To achieve sufficient magnetic field strength, the section of the drive shaft (3) surrounding the alignment magnet (19) or field sensor may be made of a non-magnetic material.

According to the preferred configuration the gravity sensor communicates with the processor via wireless communication. A commonly understood that wireless communication requires that a communication module is arranged on the platform holding the sensor/s and a receiver at the main electronic board.

The system may also include a communication interface for retrieving the stored data from the processor at any time to determine the drilling direction at a given time or periods of time and/or input for manual or autonomous downhole adjustment of drill parameters such as degree of deflection and tool face. As such the main electronic board can also be made suitable for acting as a processing hub for a range or sensors and devices.

It is emphasized that the word "directly" means that the rotational position of the reference point element (14) relative to the direction of earth gravity, is determined directly and exclusively by looking at data provided by the gravity sensor, without this excluding alternative embodiments where other sensors such as a magnetic field sensor are being used in a separate process of positioning the cradle or platform in a known position relative to the reference point element (14).

It is furthermore emphasized that the word "indirectly" means that the gravity sensor is not directly used to determinate the rotational position of the reference point element (14) relative to the direction of earth gravity, instead the gravity sensor is used in separate process of positioning the cradle or platform in a known position relative to earth gravity.

According to the preferred embodiment of the invention the alignment device is at least one alignment magnet seated on the platform (23). The alignment magnet/s (19) being configured to rotationally align said platform (23) in a known rotational position relative to the reference point element (14) due to the magnetic forces imposed between the magnets.

As an alternative embodiment the alignment device includes a motor (27) connected to the platform (23) being configured to align the platform (23) in a known rotational position relative to the reference point magnet (14) or the direction of earth's gravity.

The alignment device may then include at least one magnetic field sensor seated on platform (23) being configured to measure the rotational position of the reference point magnet (14) relative to the platform. The alignment device thus is configured to use the magnetic field sensor data as input to the motor (27) to align the platform (23) in a known rotational position relative to the reference point element (14), and the gravity sensor to measure the rotational position of the platform (23) relative to earth gravity.

In order to achieve sufficient magnetic field strength, the section the drive shaft (3) surrounding the alignment magnet/s (19) or field sensor may be made of a non-magnetic material.

As an alternative the alignment device may include using the gravity sensor data as input to control the motor (27) to align the platform (23) in a known rotational position relative to earth gravity, and the magnetic field sensor to measure the rotational position of the reference point element (14) relative to the cradle or platform (23).

The system may also include a communication interface for retrieving the stored data at any time, so as to determine the drilling direction at a given time or periods of time and/or input for manual or autonomous downhole adjustment of drill parameters such as degree of deflection and tool face.

The at least one battery and the at least one processor is located outside the platform holding the sensor/s, wherein the said processor and said power supply is connected to the platform (23) preferably wirelessly or by contactless slip-rings.

The invention claimed is:

1. A system for identifying or monitoring the orientation and position of a rotary steerable drill for drilling in bedrock, the system comprising:

a substantially non-rotating outer body element housing at least one reference point magnet;

an anti-rotation device comprising a packer, the anti-rotation device preventing the outer body element from rotating freely relative to the bedrock;

a rotating drive shaft arranged inside the outer body element and connected to a drill bit at its first end and to the drill rod or coupling thereof at its second end;

a deflection mechanism held by the substantially non-rotating outer body element and configured to tilt or push the drill bit and thereby steer the direction of drilling;

an inner body element seated inside the rotating drive shaft, drill rod or coupling thereof, the inner body element being configured to be seated permanently or retrieved from surface via a wireline;

wherein the inner body element comprises a platform suspended essentially concentrically and rotationally free within the inner body element, the platform housing at least one gravity sensor for at any time measuring direction of gravity relative to the platform, the platform comprising at least one alignment device configured to align the platform with the reference point magnet;

a main electronic board positioned in a fixed relation to the inner body element and comprising at least one processor for retrieving and storing data from the gravity sensor, the electronic board being configured to use the gravity data directly or indirectly for at any time determining a rotational orientation of the reference point magnet relative to a direction of earth gravity and thereby a rotational position of the deflection mechanism relative to the direction of earth gravity that determine the direction of drilling; and at least one power supply unit positioned in a fixed relation to the inner body element.

2. The system according to claim 1, wherein the at least one gravity sensor is a tri-axis accelerometer.

3. The system according to claim 1, wherein the alignment device is a magnet fixed to the platform.

4. The system according to claim 1, wherein the alignment device is an alignment motor, the alignment motor being connected to a magnetic field sensor housed by the platform.

5. The system according to claim 1, wherein the system includes an interface for retrieving the stored data at any time, so as to determine the drilling direction at a given time or periods of time and/or input for manual or autonomous downhole adjustment of drill parameters such as degree of deflection and tool face.

6. The system according to claim 1, wherein the platform receives electrical power wirelessly.

7. The system according to claim 1, wherein the platform receive electrical power through the respective pair of suspension means that is made of an electrically conductive material.

8. The system according to claim 1, wherein the at least one gravity sensor communicates with the processor via wireless communication.

9. The system according to claim 1, wherein at least a section the rotating drive shaft surrounding the alignment magnet is made of a non-magnetic material.

10. The system according to claim 1, wherein the at least one power supply unit is a battery or power generator providing power supply to the gravity sensor and the main electronic board.

11. The system of claim 1, wherein the inner body element may be seated in any rotational position inside the rotating drive shaft.

12. The system of claim 1, wherein the inner body element rotates along with the rotating drive shaft.

13. The system of claim 1, wherein the deflection mechanism comprises an eccentric bearing.

* * * * *